US006926655B1

(12) United States Patent
Hyvarinen et al.

(10) Patent No.: US 6,926,655 B1
(45) Date of Patent: Aug. 9, 2005

(54) METHOD OF PACKAGING A WEB, AND A PACKAGE PRODUCED THEREBY

(75) Inventors: Paavo Hyvarinen, Kotka (FI); Tapio Niemi, Kotka (FI); Jarmo Makinen, Karhula (FI)

(73) Assignee: BKI Holding Corporation, Wilmington, DE (US)

( * ) Notice: Subject to any disclaimer, the term of this patent is extended or adjusted under 35 U.S.C. 154(b) by 0 days.

(21) Appl. No.: 09/582,830

(22) PCT Filed: Dec. 23, 1998

(86) PCT No.: PCT/FI98/01022

§ 371 (c)(1),
(2), (4) Date: Sep. 21, 2000

(87) PCT Pub. No.: WO99/35073

PCT Pub. Date: Jul. 15, 1999

(30) Foreign Application Priority Data

Jan. 2, 1998 (FI) ..... 980010
Oct. 14, 1998 (FI) ..... 982230

(51) Int. Cl.[7] ..... B31F 7/00
(52) U.S. Cl. ..... 493/413; 493/433; 493/448
(58) Field of Search ..... 493/413, 414, 493/433, 204, 430, 448, 451

(56) References Cited

U.S. PATENT DOCUMENTS 32,761 A 7/1861 Elliot
1,029,459 A 6/1912 Quigley
1,463,918 A 8/1923 Borroughs
1,489,833 A 4/1924 Keller
1,985,676 A 12/1934 Hand
2,384,395 A 9/1945 Payne
2,425,301 A 8/1947 Browner ..... 100/14
2,659,187 A 11/1953 Barnes
3,245,680 A 4/1966 Harrison et al.
3,285,405 A 11/1966 Wanderer
3,321,889 A 5/1967 Zubik et al.
3,351,992 A 11/1967 Carter (Continued)

FOREIGN PATENT DOCUMENTS

AT 181590 4/1951

(Continued)

OTHER PUBLICATIONS

Amborsky RT, "Alternative Means of Packaging Airlaid Webs—Spooling & Festooning Pads" pp. 1-12, paper presented on Oct. 12, 1997 at "Insight Conference" in San Antonio, Texas.

*Primary Examiner*—Sameh H. Tawfik
(74) *Attorney, Agent, or Firm*—Darby & Darby

(57) ABSTRACT

The invention relates to a method and package for packaging a web. In the method of the invention, a web is slit into two or more narrower webs which are folded into superimposed layers. The method comprises the steps of directing the webs to a nip formed by two rotating reels and by inducing the webs, held alternately against the surfaces of the first and the second reel, to move with the reel the length of a predetermined rotational angle to provide folding, and joining the ends of the webs together so that the webs form a continuous whole whose length corresponds to the combined length of the webs.

8 Claims, 4 Drawing Sheets

U.S. PATENT DOCUMENTS

| | | | | |
|---|---|---|---|---|
| 3,429,095 | A | 2/1969 | Huson | |
| 3,499,261 | A | 3/1970 | Hullhorst et al. | |
| 3,627,306 | A | 12/1971 | Affupper | 270/79 |
| 3,632,103 | A | 1/1972 | Nikitits | 270/79 |
| 3,645,759 | A | 2/1972 | Heiligman | 99/174 |
| 3,673,757 | A | 7/1972 | Willis | 53/21 FW |
| 3,684,275 | A | 8/1972 | Schweitzer et al. | 270/79 |
| 3,697,062 | A | 10/1972 | Mones et al. | 270/30 |
| 3,729,367 | A | 4/1973 | Shore et al. | |
| 3,739,544 | A | 6/1973 | Hanemann | 53/24 |
| 3,780,908 | A | 12/1973 | Fitzpatrick et al. | 221/48 |
| 3,913,904 | A | 10/1975 | Occhetti | 270/30 |
| 3,972,519 | A | 8/1976 | Melzer | 270/30 |
| 4,053,151 | A | 10/1977 | Frezza | 270/79 |
| 4,074,901 | A | 2/1978 | Catallo | 270/79 |
| 4,097,039 | A | 6/1978 | Fischer | 270/79 |
| 4,130,679 | A | 12/1978 | Breznak et al. | 428/58 |
| 4,174,101 | A | 11/1979 | Frezza | 270/79 |
| 4,201,029 | A | 5/1980 | Lerner et al. | 53/429 |
| 4,240,854 | A | 12/1980 | Massey et al. | 156/157 |
| 4,332,583 | A | 6/1982 | Stemmler et al. | 493/430 |
| 4,406,650 | A | 9/1983 | Felix | 493/410 |
| 4,408,666 | A | 10/1983 | Lawson | 172/19 |
| 4,418,514 | A | 12/1983 | Spann | 53/436 |
| 4,427,404 | A | 1/1984 | Yamada | 493/414 |
| 4,460,291 | A | 7/1984 | Lamendour | 404/35 |
| 4,467,589 | A | 8/1984 | van Maanen | 53/450 |
| 4,488,833 | A | 12/1984 | Perry et al. | 404/35 |
| 4,493,689 | A | 1/1985 | Affupper | 493/415 |
| 4,499,707 | A | 2/1985 | Desjobert et al. | 53/429 |
| 4,512,464 | A | 4/1985 | Sylvester | 206/292 |
| 4,544,304 | A | 10/1985 | Fisher | 404/17 |
| 4,547,184 | A | 10/1985 | Bunch, Jr. | 493/414 |
| 4,564,184 | A | 1/1986 | Rumpel | 270/39 |
| 4,573,670 | A | 3/1986 | Felix | 270/39 |
| 4,597,748 | A | 7/1986 | Wolf | 493/29 |
| 4,603,817 | A | 8/1986 | O'Connor | 242/1 |
| 4,670,001 | A | 6/1987 | Campbell et al. | 493/413 |
| 4,715,925 | A | 12/1987 | Hofmeister et al. | 156/470 |
| 4,716,706 | A | 1/1988 | Boeckmann | 53/117 |
| 4,721,295 | A * | 1/1988 | Hathaway | 493/433 |
| 4,730,762 | A | 3/1988 | Felix | 225/4 |
| 4,737,045 | A | 4/1988 | Koefferlein | 400/613.2 |
| 4,805,383 | A | 2/1989 | Allwein | |
| 4,815,405 | A | 3/1989 | Young, Jr. | 112/121.14 |
| 4,824,426 | A | 4/1989 | DuFresne | 493/346 |
| 4,828,540 | A | 5/1989 | Fordyce | 493/414 |
| 4,829,918 | A | 5/1989 | Young, Jr. | 112/121.14 |
| 4,846,454 | A | 7/1989 | Parkander | 270/5 |
| 4,863,029 | A | 9/1989 | Koskol et al. | 206/393 |
| 4,907,397 | A | 3/1990 | Goodman | 53/443 |
| 4,941,374 | A | 7/1990 | Focke | 83/13 |
| 5,029,828 | A | 7/1991 | Sato et al. | 270/39 |
| 5,036,977 | A | 8/1991 | Schofield et al. | 206/389 |
| 5,041,074 | A | 8/1991 | Zwimpfer | 493/420 |
| 5,042,789 | A | 8/1991 | Hediger | 270/39 |
| 5,047,003 | A | 9/1991 | Schmidlin et al. | 493/413 |
| 5,052,995 | A | 10/1991 | Focke et al. | |
| 5,064,179 | A | 11/1991 | Martin | 270/39 |
| 5,085,624 | A | 2/1992 | Felix | 493/413 |
| 5,087,140 | A | 2/1992 | Keeton et al. | 493/23 |
| 5,104,366 | A | 4/1992 | Bunch | 493/23 |
| 5,147,273 | A | 9/1992 | Rottmann et al. | 493/349 |
| 5,177,934 | A | 1/1993 | Yamamoto | 53/429 |
| 5,201,700 | A | 4/1993 | Meschi | 493/415 |
| 5,205,808 | A | 4/1993 | Gebhardt | 493/194 |
| 5,242,057 | A | 9/1993 | Cook et al. | 206/581 |
| 5,290,226 | A | 3/1994 | Green, Jr. | 493/357 |
| 5,348,527 | A | 9/1994 | Beckwith | 493/413 |
| 5,358,140 | A | 10/1994 | Pellegrino | 221/25 |
| 5,529,564 | A | 6/1996 | Hediger | 493/413 |
| 5,558,318 | A | 9/1996 | Crowley et al. | 270/39.05 |
| 5,616,113 | A | 4/1997 | Van Den Bergh | 493/23 |
| 5,658,638 | A | 8/1997 | Pottenger | 428/126 |
| 5,690,250 | A | 11/1997 | Gooding, Jr. et al. | 221/47 |
| 5,730,695 | A | 3/1998 | Hauschild et al. | 493/416 |
| 6,176,068 | B1 | 1/2001 | O'Connor | |
| 6,263,814 | B1 | 7/2001 | O'Connor | |
| 6,321,511 | B1 | 11/2001 | O'Connor et al. | |
| 6,321,512 | B1 | 11/2001 | O'Connor et al. | |
| 6,336,307 | B1 | 1/2002 | O'Connor | |

FOREIGN PATENT DOCUMENTS

| | | | |
|---|---|---|---|
| AU | 22983/83 | 12/1983 | B65H 45/103 |
| DE | 1 141 610 | 12/1962 | |
| DE | 2 225 061 | 5/1972 | |
| DE | 81 37 577 U1 | 12/1981 | B41J 11/58 |
| DE | 198 03 837 A1 | 8/1999 | |
| EP | 0 231 412 A1 | 8/1987 | |
| EP | 0 274 737 | 12/1987 | B65H 21/00 |
| EP | 0 383 501 | 2/1990 | G07B 3/04 |
| EP | 0 763 491 A2 | 6/1996 | B65H 21/00 |
| FR | 1.357.816 | 7/1964 | |
| GB | 883100 | 12/1958 | |
| GB | 2 028 774 | 3/1980 | B65H 45/22 |
| GB | 2 193 734 | 2/1988 | B65H 45/28 |
| JP | 57-47638 | 3/1982 | B29C 27/16 |
| JP | 63-176257 | 7/1988 | |
| JP | 2-182666 | 7/1990 | B65H 45/101 |
| JP | 2678390 | 8/1997 | |
| SU | 1555-205 A | 4/1990 | B65D 85/08 |
| WO | 98/58864 | 12/1998 | |
| WO | 99/35073 | 7/1999 | B65H 35/02 |

* cited by examiner

METHOD OF PACKAGING A WEB, AND A PACKAGE PRODUCED THEREBY

This application is a 371 of PCT/FI98/01022 Dec. 23, 1998.

FIELD OF THE INVENTION

The invention relates to a method of packaging a web and to a package produced by the method.

BACKGROUND OF THE INVENTION

Webs intended for sanitary products are typically made from natural fibers, such as wood fibers, and synthetic fibers or mixtures thereof, by binding the web by binders or bonding fibers. All web production methods are feasible, such as different wet and dry methods, including what is known as dry web forming and carding. By a web machine, such as a dry web machine, the web is typically reeled to what is known as a jumbo reel, which is then longitudinally slit into narrower reels of a desired width. During production, these narrower reels are distributed and fed to a preparing machine. However, the width of the web used in the preparing machine may be as narrow as 30 mm, and reeled as a round reel it does not hold together very well, and, most importantly, contains a comparatively small amount of web material. This is why reels have to be changed very often, even at intervals of a few minutes, when web is fed to the preparing machine. It is uneconomical to transport web either as a jumbo reel or as narrower reels formed by slitting, since relatively much waste space is bound to remain between the round reels.

SUMMARY OF THE INVENTION

It is an object of the present invention to produce a novel method and a package produced thereby for packaging a web, which avoid the above problems mainly relating to the use of round web reels in preparing machines and the transport of same to preparing machines. This is achieved by the method of packaging a web according to the invention, in which method a web is slit into two or more narrower webs which are folded into superimposed layers. The method is characterized by comprising the steps of directing the webs to a nip formed by two rotating reels and by inducing the webs, held against the surfaces of the first and the second reel, to move with the reel alternately the length of a predetermined rotational angle to provide folding, and joining the ends of the webs together so that the webs form a continuous whole whose length corresponds to the combined length of the webs. Thus the web material forms a single continuous whole which can also be distributed as a continuous web during further processing. Webs obtained by slitting from a wide web can be joined together at their ends in principle in two alternative ways, either by joining the forward end of a web and the forward end of an adjacent web together or by joining together the ends of adjacent webs in pairs. In the former case, the web is continuously distributed in the same direction and in the latter, alternately in opposite directions. In practice, this manner of distributing may affect the operation of the further processing device of the web.

The package for packaging web according to the invention is in turn characterized by comprising two or more side-by-side stacks of superimposed web layers formed by folding the web, the ends of the webs in the stacks being joined together so that the webs form a continuous whole whose length corresponds to the combined length of the webs.

The package preferably comprises around the stacks a solid outer casing made from e.g. corrugated cardboard or plastic film.

When the method and package of the invention are used, the web material placed in a substantially parallelepiped-shaped package constitutes one continuous web which can be distributed as a continuous whole by a preparing machine. This avoids the need for frequent reel changes. The package is generally parallelepiped-shaped, completely filled by the material to be packaged, allowing a very high packaging density during web transport.

The forward and tail ends of the joined continuous web in the package of the invention preferably extend to the outside of the outer casing of the package to allow webs in several packages to be easily combined to a single still longer whole e.g. in view of distributing by a preparing machine.

BRIEF DESCRIPTION OF THE DRAWINGS

In the following the method and package of the invention will be described in greater detail with reference to the attached drawing, in which FIG. 1 schematically shows a first exemplary embodiment of an equipment utilizing the method of the invention, FIG. 2 schematically shows a second exemplary embodiment of an equipment utilizing the method of the invention, FIG. 3 schematically shows the operational principles of the method of the invention.

DETAILED DESCRIPTION OF THE INVENTION

Figure 1:
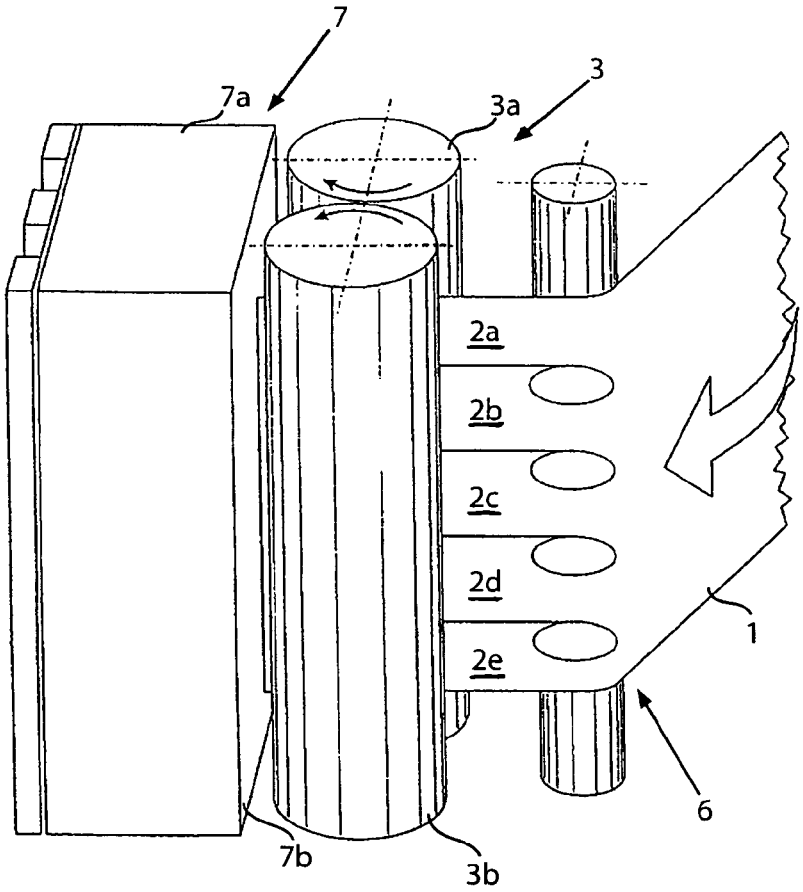

FIG. 1 schematically shows an exemplary embodiment of a packaging equipment utilizing the method of the invention. A web 1, typically made e.g. by dry forming from natural fibres, such as wood fibre, and synthetic fibres or mixtures thereof by binding the web by a binder or binding fibres, is led to a packaging equipment employing the method of the invention. The equipment shown in FIG. 1 comprises folding reels 3, the reels being placed in a vertical position. As will be described in more detail in association with FIG. 3, while folding it, the reels pull the web 1 into a packing box 7. Before the web 1 enters the folding reels, it is slit by slitter blades 6 into webs 2*a* to 2*e* of a desired width. The widths of the webs 2*a* to 2*e* typically vary between 200 and 30 mm, and hence the number of webs varies correspondingly with the web width used and the desired web width. Such webs are typically used in the production of sanitary products, such as sanitary napkins, panty liners, diapers etc.

Figure 3:
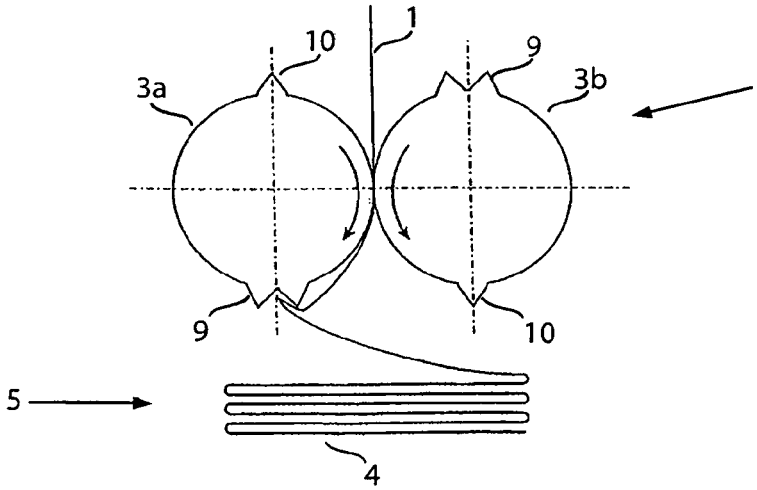

The webs 2*a* to 2*e* are directed to a nip formed by two rotating reels 3*a* and 3*b*, and induced, held alternately against the surfaces of the first and second reel, to shift with the reel the length of a predetermined rotational angle to provide folding, as is shown in FIG. 3. The folding reels 3, comprising two folding reels 3*a* and 3*b* rotating in opposite directions, simultaneously pulls the web 1 forward. The webs 2*a* to 2*e* are held against the surface of the reel by mechanical engagement of the web by means 9 and 10 disposed on the surface of the reel and/or by suction using underpressure, the surface of the reel being perforated in the angle area covering at least part of the surface of the reel.

Figure 4:
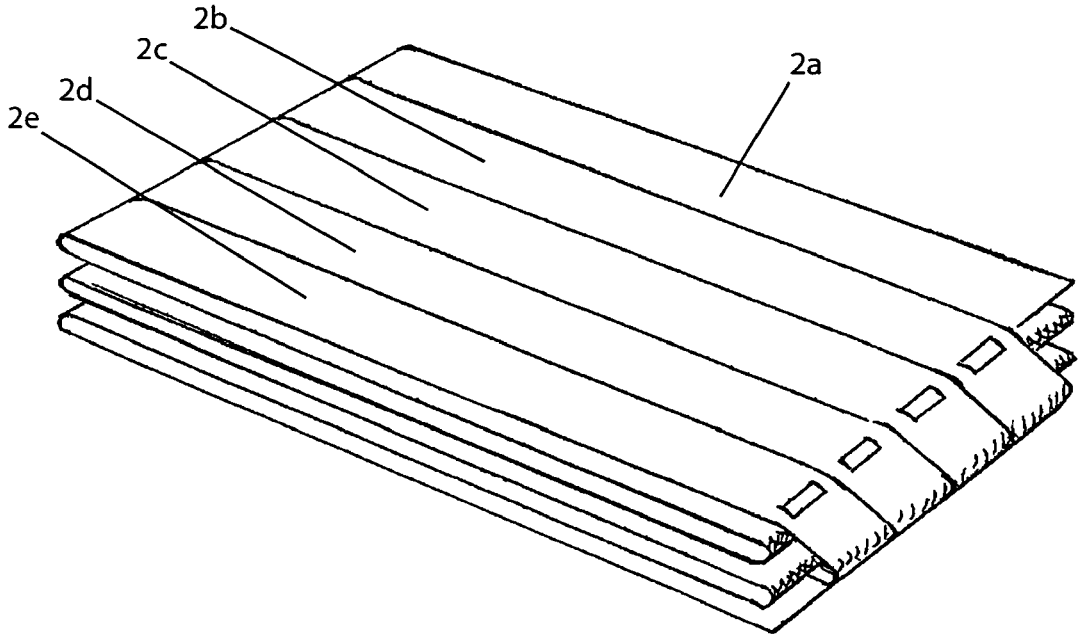
FIG. 4 is a perspective view schematically showing a first method of joining ends of the slit webs.
Figure 5:
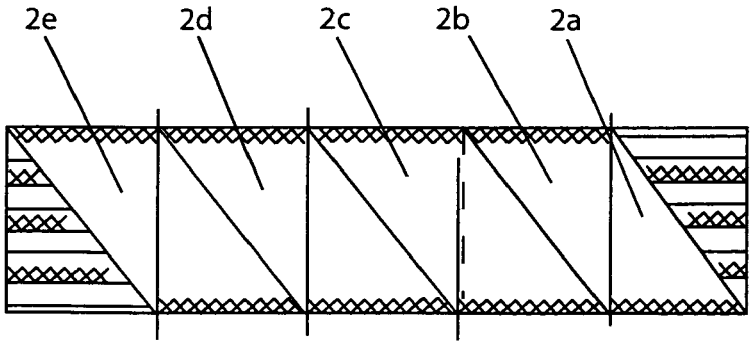
FIG. 5 is an end view of the joined ends according to the method illustrated in FIG. 4.

The ends of the slit webs must be joined together for the slit webs to form a continuous whole. In principle, two alternative methods can be used to join the webs. The first method, illustrated in FIGS. 4 and 5, involves joining the forward/tail end of the outermost web to the forward/tail end of the adjacent web, whose forward/tail end is joined to the forward/tail end of the next web, the process continuing until all webs are joined to a continuous whole whose length corresponds to the combined length of the webs. In this method the webs are not joined until after folding, and therefore they cannot be folded directly into the package, such as a cardboard box or a plastic bag. This method allows the folded continuous whole formed by the joined web stacks to be placed in the package only after the ends are joined. An advantage of this method is that the distributing direction remains the same throughout the distributing of the web from the package. If the stacks formed by the webs 2*a* to 2*e* are side by side during distributing, the outermost web can be distributed first from top to bottom, and since the tail end of the web is joined to the forward end of the adjacent web said adjacent web can also be distributed from top to bottom.

Figure 2:
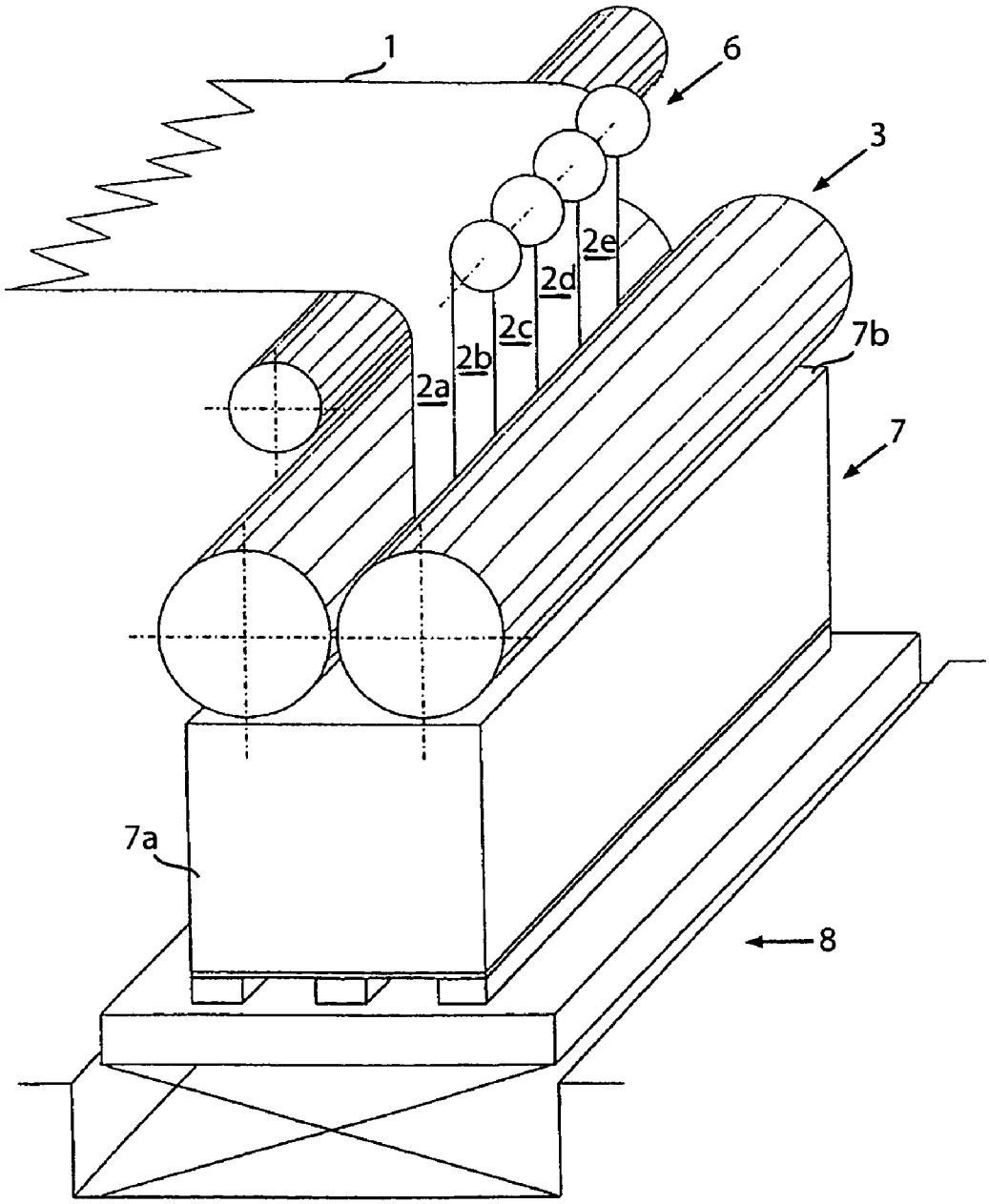
Figure 6:
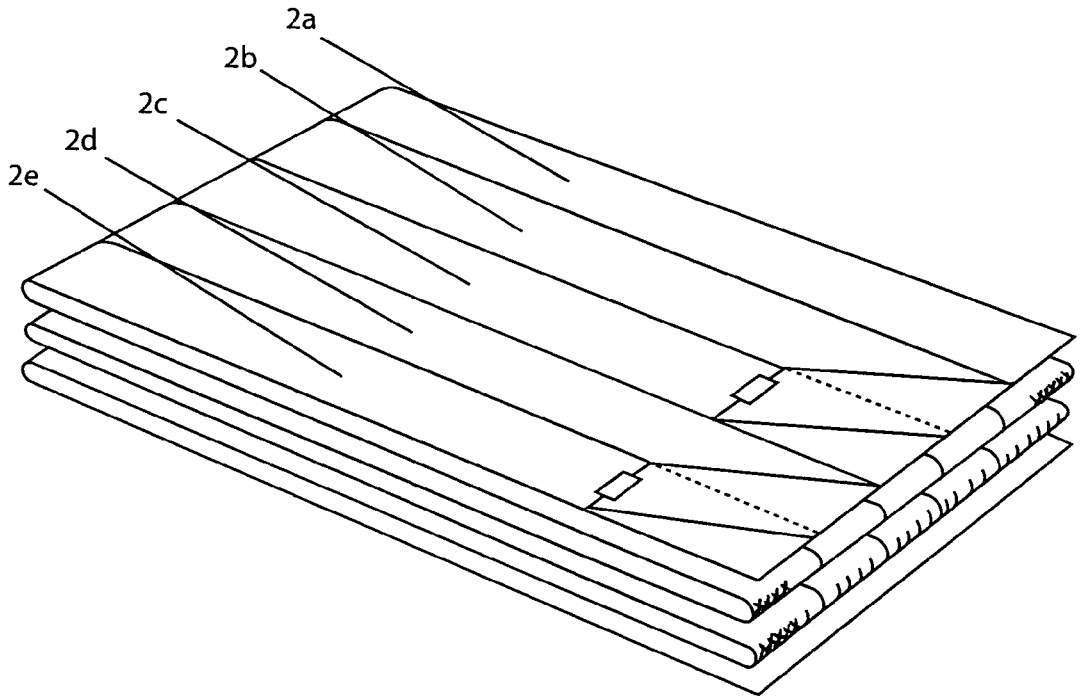
FIG. 6 is a top perspective view schematically showing a second method of joining ends of the slit webs.
Figure 7:
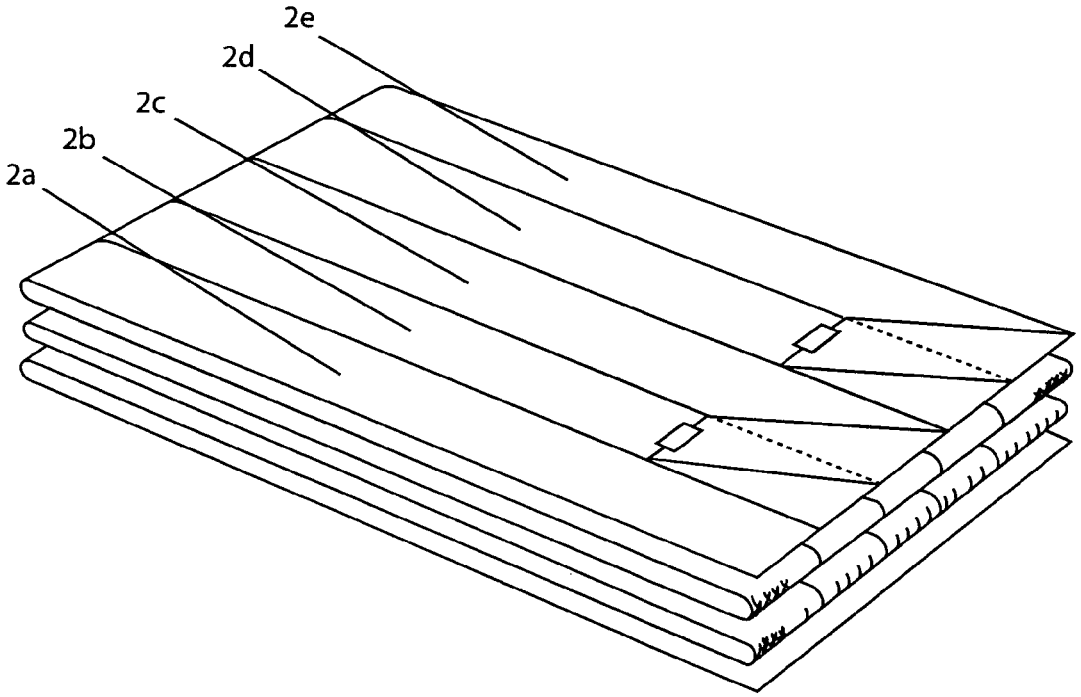
FIG. 7 is a bottom perspective view schematically showing the joined ends according to the second method.

An alternative joining method illustrated in FIGS. 6 and 7, which is suitable for folding directly into a package, as shown by FIGS. 1 and 2, is to join together the forward and tail ends of the webs 2*a* to 2*e* in pairs, the pairs being formed at one end of the webs starting from the outermost web 2*a*, and at the other ends of the webs the pairs are formed starting from the next to the outermost web 2*b*. In this case in the embodiment of e.g. FIG. 1, the pairs of forward ends of the webs are formed from the webs 2*a* and 2*b*, and the webs 2*c* and 2*d*. These ends are joined together preferably before folding, so that these ends no longer have to be dug up from the bottom of the package after the webs have been folded directly into the package, which would be possible e.g. via a packing box bottom that could be opened. When starting the folding into the packing box 7, the forward end of the web 2*e*, which can be thought to form the last portion of the continuous web to be formed to the package, i.e. the end remaining at the bottom, can be left visible if desired, to allow joining it to one end of a continuous web disposed in another similar package.

After the forward ends of the webs have been joined, the folding reels 3 start to pull the web into the packing box simultaneously folding it into superimposed layers, denoted by reference number 4 in FIG. 3. By correct dimensioning of the reels 3*a* and 3*b* of the folding reels 3 and the packing box 7, the box can be filled by precisely superimposed layers of folded web 1. Once the packing box 7 is filled, the web 1 is cut and the free tail ends of the webs 2*a* to 2*e* are joined together in pairs, the pairs being formed starting from the second outermost web 2*b*. The webs 2*b* and 2*c* are consequently joined together, and similarly the webs 2*d* and 2*e* are joined together at their tail ends. In this way several side-by-side stacks, denoted by reference number 5 in FIG. 3, are formed in the packing box 7 by folded superimposed web layers 4, the forward and tail ends of the webs in the stacks being joined together in pairs so as to form a continuous whole whose length corresponds to the combined length of the webs 2*a* to 2*e*. When the package is being closed, the free end of the web 2*a*, which can be thought to form the first part of the continuous web to be formed into the package, i.e. the end on top of the package, is left visible to enable one end of a web in a similar package to be joined to it.

When the package of the invention, i.e. the packing box 7 in the case of FIGS. 1 and 2, is conveyed to a preparing machine, it will be possible to distribute the webs from the package as a single continuous whole. In practice, as the box was packed via side 7*b*, this is accomplished by opening side 7*a* of the box 7. By grabbing the free end of the web 2*a*, the entire web 2*a* can be distributed from the end 7. As described above, its tail end is joined to the tail end of the web 2*b*, and consequently the web 2*b* starts to distribute from the package as the end of the web 2*a* is reached. In this way all webs 2*a* to 2*e* are distributed from the package as a continuous whole. When packing boxes 7 are placed in succession on a conveyor and the visible forward end of a web therein is joined to the visible tail end of the web in the preceding packing box, and, similarly, the visible tail end is joined to the visible forward end of the web in the next packing box, several packages can be chained on the conveyer, and the preparing machine does not have to be stopped even when the web starts to distribute from a new package.

FIG. 2 shows a second exemplary embodiment of an equipment implementing the packaging method of the invention, with the folding reels placed in a vertical position. Other parts of the equipment and its structure and operation completely correspond to those of the equipment shown in FIG. 1. It is obvious that when studying the folding procedure of FIG. 3 in particular, that the equipment of FIG. 2 can easily fold the webs in the desired manner into adjacent stacks into a packing box 7. The equipment shown in FIG. 1 also operates in the same manner, and this is because the material of the web 1 is typically very light, the effect of gravity thereon remaining very slight, particularly considering that the travel speed of the web 1 is assumed to be up to 400 meters per minute. At such a speed the web 1 is folded into the box without problems with the folding reels 3*a* and 3*b* pushing it into the box. If the web width is e.g. 38 mm, 15,000 meters of web, for example, can be packaged into one packing box.

In FIG. 2, the packing box 7 is placed on a lifting table 8 facilitating the joining together of the web ends, as it will be possible to lower the packing box to the side of the folding reels 3, whereby it is easier to join together the web ends at their forward and tail ends in the desired manner. A similar manner of changing the distance between the folding reels 3 and the packing box 7 may naturally also be applied to the embodiment of FIG. 1.

FIG. 3 schematically shows how the web 1 is folded in the manner of the invention. The web 1 is folded by means of the reels 3*a* and 3*b* by rotating the reels in opposite directions so that they pull the web 1. Mechanical grippers 9, to which the web 1 adheres by the action of a blade-like or strip-like projection 10, are placed at the peripheries of the diametrically placed reels 3*a* and 3*b*. Accordingly, the blade or metal strip 10 in one reel pushes the web between two spring-loaded gripper parts 9 to make the web adhere to said gripper 9. As the reels rotate forward, the reel moves the web along a path defined by the periphery of the reel to a position in which the web 1 is to be detached from the reel. In FIG. 3, the web is attached to the gripper 9 of the reel 3*a* and is in a position where the web 1 must still be fastened to the gripper 9.

Very soon after the position shown in FIG. 3, the reel 3*a* rotates to a position in which the web 1 is to be detached from the gripper 9. This can be accomplished by means of e.g. an eccentric arrangement, which opens the spring-loaded gripper 9 detaching the web. At the same moment, blades 10 on opposite sides of the reels and the gripper 9 of the second reel have gripped the web 1. In this manner the second reel 3*b* in turn moves the web to its side at a desired distance. Thus the web 1 can be folded in the manner shown in FIG. 3 into superimposed layers 4, which form a stack 5. Let it be pointed out that the operation of the gripper 9 can be intensified by directing to the web a suction via suction openings arranged in the reel in that portion of the reel in which the web is to adhere to the reel. In fact, if desired, the entire gripper could be replaced by such a suction zone provided the properties of the web 1 allow this. On the other hand, the grippers outlined in FIG. 3 achieve this reliably enough.

The ends of the webs 2*a* to 2*e* can be joined together in many alternative ways depending partly on the properties of the web, such as tear resistance, and future use of the web, e.g. if the joint can be left in the finished product or should a product containing a joint be rejected. Depending on these conditions, the webs can be joined by: sewing, taping, gluing, needling, hot sealing, ultrasound sealing, stapling or the like.

As shown above in FIGS. 1 and 2, the web 1 is folded into a packing box 7. However, it is feasible that the package is not such a box 7, but e.g. merely a plastic film. It is feasible that the web 1 is folded into a bag made of plastic film and bearing against a suitable holder. As to the web stacks which are result of folding the web, it is not very relevant what kind of outer casing supports them, as long as it allows the webs to be folded and distributed in the manner described, and the web stacks to be conveyed to the preparing machine. Similarly, if the web is not placed in the package until after folding and joining of the ends, the outer cover of the package can be either a box or a plastic film, which is able to hold the stacks together suitably squeezed to achieve an optimal packaging density.

The method and package of the invention for packaging a web have been described above only by means of some exemplary embodiments and it is to be understood that the described solutions can be varied to some extent without deviating from the scope defined by the attached claims.

What is claimed is:

1. A method of packaging a web comprising:

slitting a web to form a slit web of two or more narrower webs; and folding the slit web into superimposed layers by:

directing the slit web to a single nip formed by first and second rotating reels, inducing the slit web to move with the first and second rotating reels a length of a predetermined rotational angle to provide simultaneous folding of the two or more narrower adjacent webs of the slit web by holding the two or more narrower webs alternatively against surfaces of the first and second rotating reels to simultaneously form adjacent stacks, the narrower web of each stack having a first end and a second end, and joining the ends of the two or more narrower webs together so that the two or more narrower adjacent webs form a continuous web whose length corresponds to a combined length of the two or more narrower adjacent webs.

2. The method of claim 1, wherein the step of joining the ends of the two or more narrower webs comprises joining a first end of an outermost stack to a second end of an adjacent stack, whose first end is joined to a second end of a next adjacent stack, the joining process continuing until all of the webs are joined to form a continuous whole whose length corresponds to the combined length of the two or more narrower webs.

3. The method of claim 1, wherein the step of joining the ends of the two or more narrow webs comprises joining the first ends of the two or more stacks in pairs, the pairs being formed at one end of the stacks beginning with an outermost stack, and at the other end the pairs being formed starting from the stack next to the outermost stack, the webs of the stacks forming a continuous whole whose length corresponds to the combined length of the two or more narrower webs.

4. The method of claim 1, wherein the step of holding the two or more narrower webs alternatively against surfaces of the first and second rotating reels comprises holding the webs against the surfaces of said reels by mechanical engagement of the web by means disposed on the surfaces of said reels.

5. The method of claim 4, wherein the means comprises at least one mechanical gripper and at least one projection extending outwardly from a periphery of the first and second rotating reels.

6. The method of claim 1, wherein the step of holding the two or more narrower webs comprises holding the webs against the surfaces of the first and second rotating reels by mechanical engagement of the web by suction using underpressure.

7. The method of claim 1, wherein the ends of the two or more narrower webs are joined by a process selected from the group consisting of sewing, taping, gluing, needling, hot sealing, ultrasound sealing, and stapling.

8. A method of packaging a web comprising:

slitting a web to form a slit web of two or more narrower webs; and folding the slit web into superimposed layers by:

directing the slit web to a single nip formed by first and second rotating reels, inducing the slit web to move with the first and second rotating reels a length of a predetermined rotational angle to provide simultaneous folding of the two or more narrower adjacent webs of the slit web by holding the two or more narrower webs alternatively against surfaces of the first and second rotating reels to simultaneously form adjacent stacks, the narrower web of each stack having a first end and a second end, wherein the narrower webs are delivered to a single container during the folding step resulting in the adjacent stacks being disposed within the single container, and joining the ends of the two or more narrower webs together so that the two or more narrower adjacent webs form a continuous web by joining the first ends of the two or more stacks in pairs, the pairs being formed at one end of the stacks beginning with an outermost stack, and at the other end the pairs being formed starting from the stack next to the outermost stack, the webs of the stacks forming a continuous whole whose length corresponds to the combined length of the two or more narrower webs.

* * * * *